US006078001A

United States Patent [19]

Kang

[11] Patent Number: 6,078,001

[45] Date of Patent: Jun. 20, 2000

[54] MACHINE HEAD FOR GUITARS

[76] Inventor: Han Soo Kang, 264-14, Kaebong-Dong, Kuro-Ku, Seoul, Rep. of Korea

[21] Appl. No.: 09/346,948

[22] Filed: Jul. 2, 1999

[51] Int. Cl.[7] ..... G10D 3/14

[52] U.S. Cl. ..... 84/304; 84/297 R; 84/200; 84/202; 84/454; 84/455; 84/305

[58] Field of Search ..... 84/303, 304, 305, 84/200, 202, 206, 453, 454, 455, 297 R

[56] References Cited

U.S. PATENT DOCUMENTS

| | | | |
|---|---|---|---|
| 554,057 | 2/1896 | Durkee | 84/304 |
| 4,377,963 | 3/1983 | Siminoff | 84/297 R |
| 4,589,321 | 5/1986 | Pritchard | 84/297 R |

*Primary Examiner*—Robert E. Nappi
*Assistant Examiner*—Shih-yung Hsieh
*Attorney, Agent, or Firm*—Jacobson, Price, Holman & Stern, PLLC

[57] ABSTRACT

A machine head for guitars is disclosed. In the machine head, the tension of a string is adjusted by sequentially rotating a manually operated adjusting knob, a worm engaging with the knob, a worm wheel engaging with the worm, and a winding peg integrated with the worm wheel with the string wound on or unwound from the winding peg. A cap guider is formed on the top end of the winding peg, while a string holding cap is rotatably fitted over the cap guider of the winding peg, thus being brought into a rotatable engagement with the guider. In an embodiment, the guider has upper and lower guide discs integrated at both ends of an eccentric shaft, while the cap has two string insert holes on its sidewall at eccentric positions. When the winding peg is rotated with a string passing through the two string insert holes, the string is firmly jammed at the junction between the eccentric shaft and the sidewall of the string holding cap. The machine head thus allows a user to easily hold a string to the winding peg without catching the end of the string with the fingers.

4 Claims, 9 Drawing Sheets

MACHINE HEAD FOR GUITARS

BACKGROUND OF THE INVENTION

1. Field of the invention

This invention relates to a machine head for guitars, used for adjusting the tension of guitar strings, and, more particularly, to a machine head designed to easily hold a string to the head of a guitar.

2. Description of the prior art

In general, a machine head for guitars, mounted to the head of a guitar, is used for holding the end of a string to the head of the guitar while appropriately tensioning the string by rotating an adjusting knob. FIGS. 8 and 9 show a conventional machine head for guitars.

As shown in the drawings, the body 430 of a conventional machine head 400 has two bores, a vertical sleeve bore 432 and a horizontal bore 434 communicating with each other. The vertical sleeve bore 432 receives a rotatable winding peg 410. The peg 410 is used for adjusting the tension of a string by winding or unwinding the string thereon or therefrom. On the other hand, the horizontal bore 434 receives a worm shaft 450 used for rotating the winding peg 410.

In a detailed description, the stepped worm shaft 450 has a worm 451 at its large-diameter outside end portion. A connection shaft portion 452, having an internal thread 453, is formed at the small-diameter inside end portion of the worm shaft 450. Therefore, when the worm shaft 450 is inserted into the horizontal bore 434 of the body 430, the worm 451 is placed within the horizontal bore 434, while the connection shaft portion 452 protrudes outwardly from a tapered horizontal sleeve 433 of the body 430 to a length.

After two washers 481 and 482 are fitted over the worm shaft 450 at a position externally protruding from the body 430, a first set screw 491 is driven into the internal thread 453 of the worm shaft 450. In such a case, the screw 491 passes through a connection bore 441 of the adjusting knob 440. The above adjusting knob 440 and the worm shaft 450 are thus integrated together while being rotatably assembled with the body 430.

A vertical sleeve 431 projects upwardly from the top of the body 430 and has the sleeve bore 432 therein, with an internal thread 431*a* formed on the interior surface of the sleeve bore 432. An annular stopper 431*b* is formed at the inside end of the internal thread 431*a* as shown in the FIG. 9, with a worm wheel 460 placed in the seat formed within the body 430 at a position under the stopper 431*b* and engaging with the worm 451 of the worm shaft 450.

In addition, a serration 461 is formed on the interior surface of the center hole of said worm wheel 460, while a serrated portion 411 is formed at the stepped lower end of the winding peg 410 and engages with the serration 461 of the worm wheel 460. An internal thread 412 is formed on the lower end portion of the winding peg 410, thus allowing a second set screw 492 to be threaded into the winding peg 410 so as to assemble the worm wheel 460 with the winding peg 410.

Accordingly, when the winding peg 410 is inserted into the vertical sleeve bore 432 of the body 430, the lower serrated portion 411 of the peg 410 is fitted into the serration 461 of the worm wheel 460 prior to threading the screw 492 into the internal thread 412 of the winding peg 410. The winding peg 410 and the worm wheel 460 are thus brought into engagement with each other while being rotatably held in the body 430 by the annular stopper 431*b*. The lower opening of the vertical sleeve bore 432 is closed by a cover 470, thus hiding the worm wheel 470 from the outside.

The body 430 is set in a locking hole of the guitar head at the vertical sleeve 431. In such a case, a locking member 420, having an external thread 421 corresponding to the internal thread 431*a* of the vertical sleeve 431, is locked to the vertical sleeve 431 along with a washer 483, thus locking the machine head 400 to the head of the guitar. In such a case, the winding peg 410 is inserted into the body 430 through the central bore 422 of the locking member 420.

When it is necessary to hold a string to the machine head 400, one end of the string is inserted into a string hole 413 formed at a spool portion of the winding peg 410 prior to rotating the adjusting knob 440 while catching the string around the string hole 413 with the fingers. When the adjusting knob 440 is rotated as described above, the worm shaft 450 is rotated, and so the worm wheel 460, engaging with the worm 451 of the shaft 450, is rotated. The winding peg 410 is thus rotated. When the peg 410 is rotated, the string is appropriately wound around the spool portion of the peg 410 several turns until the end of the string is frictionally held by the tensioned turns of the string and is prevented from being unexpectedly removed from the peg 410 due to the tensile force of the string. The desired tension of the string is, thereafter, achieved by further and precisely rotating the adjusting knob 440 in either direction.

However, the conventional machine head is problematic in that it is necessary for a user to catch the end of the string at a position around the spool portion of the winding peg with the fingers until the string is firmly and frictionally held on the winding peg due to a rotating action of the adjusting knob. This is inconvenient to the user while holding the string on a guitar.

SUMMARY OF THE INVENTION

Accordingly, the present invention is the solution of the above problems occurring in the prior art, and an object of the present invention is to provide a machine head for guitars, which is designed to allow a user to easily hold a string to the winding peg of the machine head without catching the end of the string with the fingers.

In order to accomplish the above object, the primary embodiment of the present invention provides a machine head for adjusting the tension of a string in guitars by sequentially rotating a manually operated adjusting knob, a worm engaging with the knob, a worm wheel engaging with the worm, and a winding peg integrated with the worm wheel with the string wound on or unwound from the winding peg, further comprising: a cap guider formed on a top end of the winding peg and having upper and lower guide discs integrated with both ends of an eccentric shaft; and a string holding cap rotatably fitted over the cap guider, thus being brought into a rotatable engagement with the guider, the string holding cap having two string insert holes on its sidewall at eccentric positions.

The second embodiment of this invention provides a machine head for guitars, comprising: a cap guider formed on a top end of the winding peg, the guider having: a first string insert hole radially formed on the guider while being perpendicular to an axis of the winding peg; and a bearing projection upwardly formed on a top end of the guider; and a string holding cap rotatably fitted over the cap guider of the winding peg, thus being brought into a rotatable engagement with the guider, the string holding cap having: a second string insert hole formed on a sidewall of the cap and operated in conjunction with the first string insert hole; and a bearing hole formed on a top wall of the cap and rotatably receiving the bearing projection of the guider therein, with the cap rotatably held on the guider by the bearing projection through a riveting process.

The third embodiment of this invention provides a machine head for guitars, comprising: a cap guider formed on a top end of the winding peg, with a first string insert slit diametrically formed on the guider along an axis of the winding peg; and a string holding cap rotatably fitted over the cap guider of the winding peg, thus being brought into a rotatable engagement with the guider, with a second string insert slit diametrically formed on the cap and operated in conjunction with the first string insert slit of the guider while holding the string on the winding peg.

BRIEF DESCRIPTION OF THE DRAWINGS

The above and the other objects, features and advantages f the present invention will be clearly understood from the following detailed description taken in conjunction with accompanying drawings, wherein.

DESCRIPTION OF THE PREFERRED EMBODIMENTS

Figure 1:
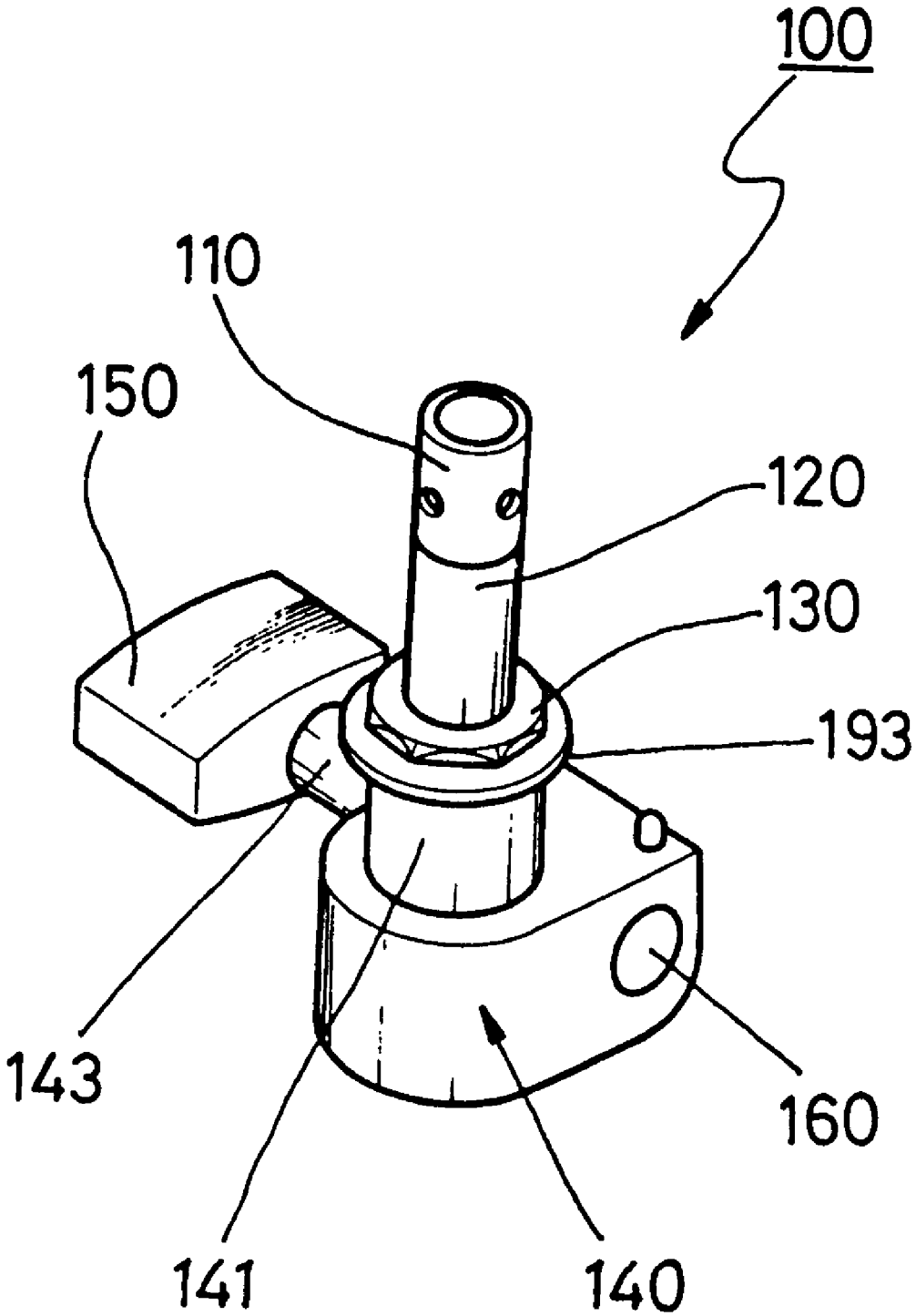
FIG. 1 is a perspective view of a machine head for guitars in accordance with the primary embodiment of the present invention.
Figure 2:
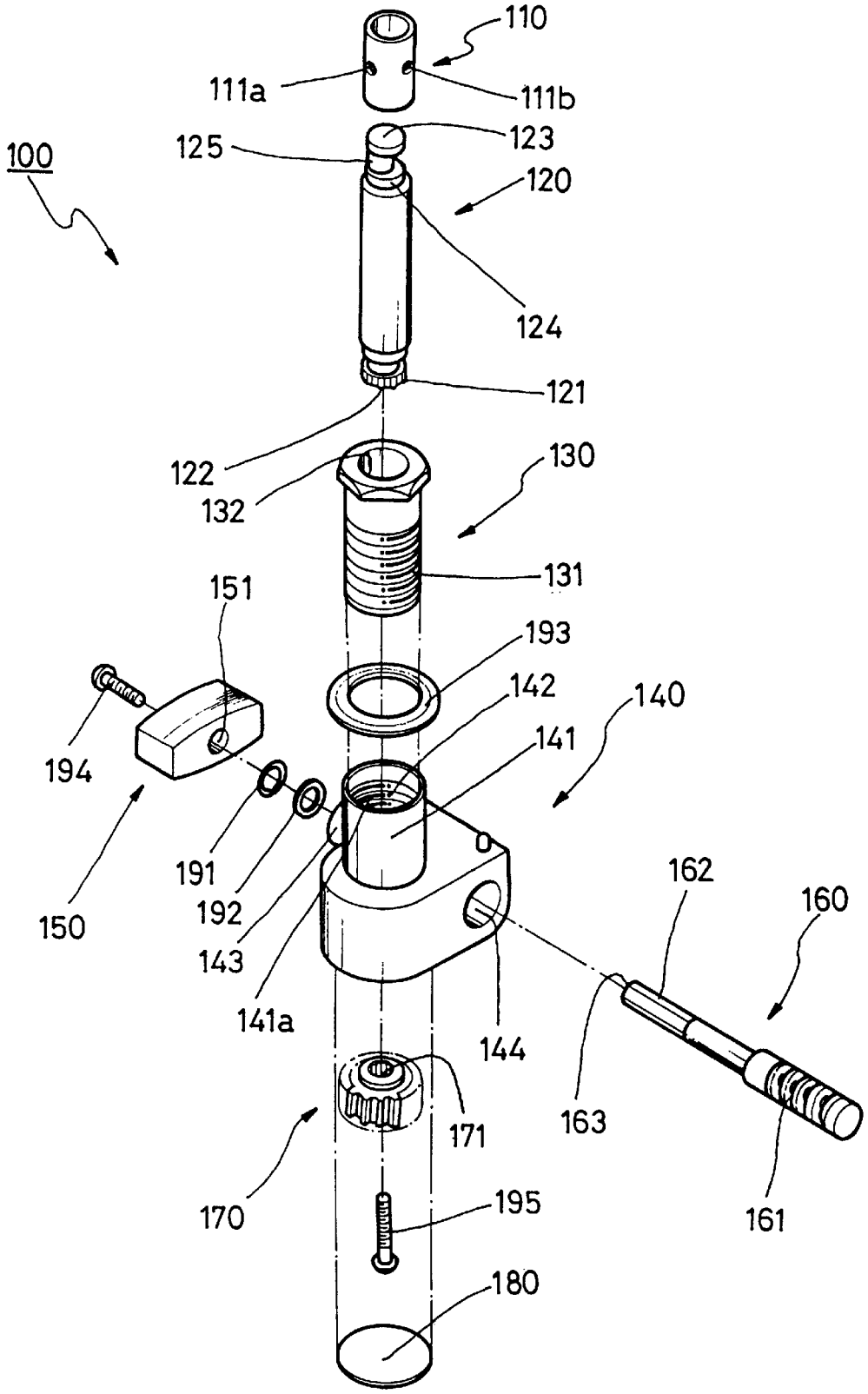
FIG. 2 is an exploded perspective view of the machine head in FIG. 1.

FIG. 1 is a perspective view of a machine head for guitars in accordance with the primary embodiment of the present invention. FIG. 2 is an exploded perspective view of the machine head in FIG. 1.

As shown in the drawings, the body 140 of the machine head 100 according to this invention has two bores, a vertical sleeve bore 142 and a horizontal bore 144 communicating with each other. The vertical sleeve bore 142 receives a rotatable winding peg 120 which is used for adjusting the tension of a string by winding or unwinding the string thereon or therefrom. On the other hand, the horizontal bore 144 receives a worm shaft 160 used for rotating the winding peg 120.

In a detailed description, the stepped worm shaft 160 has a worm 161 at its large-diameter outside end portion. A connection shaft portion 162, having an internal thread 163, is formed at the small-diameter inside end portion of the worm shaft 160. Therefore, when the worm shaft 160 is inserted into the horizontal bore 144 of the body 140, the worm 161 is placed within the horizontal bore 144, while the connection shaft portion 162 protrudes outwardly from a tapered horizontal sleeve 143 of the body 140 to a length.

After two washers 191 and 192 are fitted over the worm shaft 160 at a position externally protruding from the body 140, a first set screw 194 is driven into the internal thread 163 of the worm shaft 160. In such a case, the screw 194 passes through a connection bore 151 of the adjusting knob 150. The above adjusting knob 150 and the worm shaft 160 are thus integrated together while being rotatably assembled with the body 140.

A vertical sleeve 141 projects upwardly from the top of the body 140 and has the sleeve bore 142 therein, with an internal thread 141*a* formed on the interior surface of the sleeve bore 142. An annular stopper (not shown) is formed at the inside end of the internal thread 141*a*, with a worm wheel 170 placed in the seat formed within the body 140 at a position under the annular stopper and engaging with the worm 161 of the worm shaft 160. A serration 171 is formed on the interior surface of the center hole of said worm wheel 170, while a serrated portion 121 is formed at the stepped lower end of the winding peg 120 and engages with the serration 171 of the worm wheel 170.

An internal thread 122 is formed on the lower end portion of the winding peg 120, thus allowing a second set screw 195 to be threaded into the winding peg 120 so as to assemble the worm wheel 170 with the winding peg 120. Accordingly, when the winding peg 120 is inserted into the vertical sleeve bore 142 of the body 140, the lower serrated portion 121 of the peg 410 is fitted into the serration 171 of the worm wheel 170 prior to threading the screw 195 into the internal thread 122 of the winding peg 120. The winding peg 120 and the worm wheel 170 are thus brought into fixed engagement with each other while being rotatably held in the body 140 by the annular stopper. The lower opening of the vertical sleeve bore 142 of the body 140 is closed by a cover 180, thus hiding the worm wheel 170 from the outside.

A cap guider, comprising upper and lower guide discs 123 and 124 integrated with both ends of an eccentric shaft 125, is formed at the top end of the winding peg 120. The cap guider is covered with a string holding cap 110. The above string holding cap 110, having two string insert holes 111*a* and 111*b* on its sidewall at eccentric positions, is rotatably held on the top portion of the winding peg 120 by the upper guide disc 123 through a riveting process.

The body 140 of the machine head 100 is set in a locking hole of the guitar head at the vertical sleeve 141. In such a case, a locking member 130, having an external thread 131 corresponding to the internal thread 141*a* of the vertical sleeve 141, is locked to the vertical sleeve 141 along with a washer 193, thus locking the machine head 100 to the head of the guitar. In such a case, the winding peg 120 is inserted into the body 140 through the central bore 132 of the locking member 130.

Figure 3A:
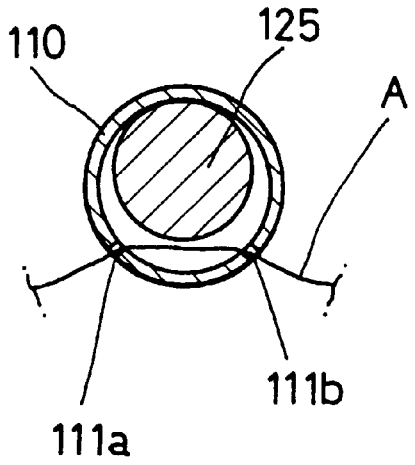
FIGS. 3*a* and 3*b* are cross-sectioned views of FIG. 1, respectively showing the operation of the machine head.

In order to hold a string A to the machine head 100, one end of the string A passes through the two string holes 111*a* and 111*b* of the cap 110 as shown in FIG. 3*a* prior to rotating the adjusting knob 150 in either direction. When the adjusting knob 150 is rotated as described above, the worm shaft 160 is rotated. Such a rotating action of the worm shaft 160 allows both the worm wheel 170 and the winding peg 120 to be rotated. In such a case, the string holding cap 110 is not rotated, while the winding peg 120 is rotated.

Figure 3B:
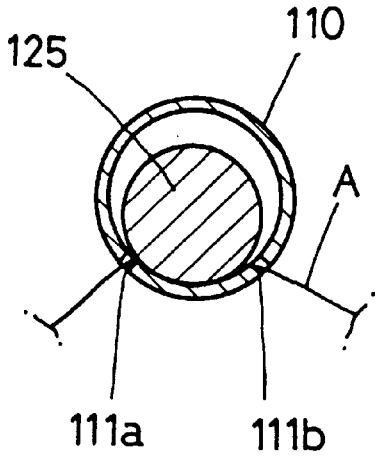

When the winding peg 120 is further rotated, the string A is firmly jammed at the junction between the eccentric shaft 125 and the sidewall of the string holding cap 110 as shown in FIG. 3*b*. After the string A is jammed at the junction, the string holding cap 110 starts to be rotated in conjunction with the winding peg 120, thus winding the string A thereon. Thereafter, the desired tension of the string A is achieved by a further and precise rotation of the adjusting knob 150 in either direction.

Figure 4:
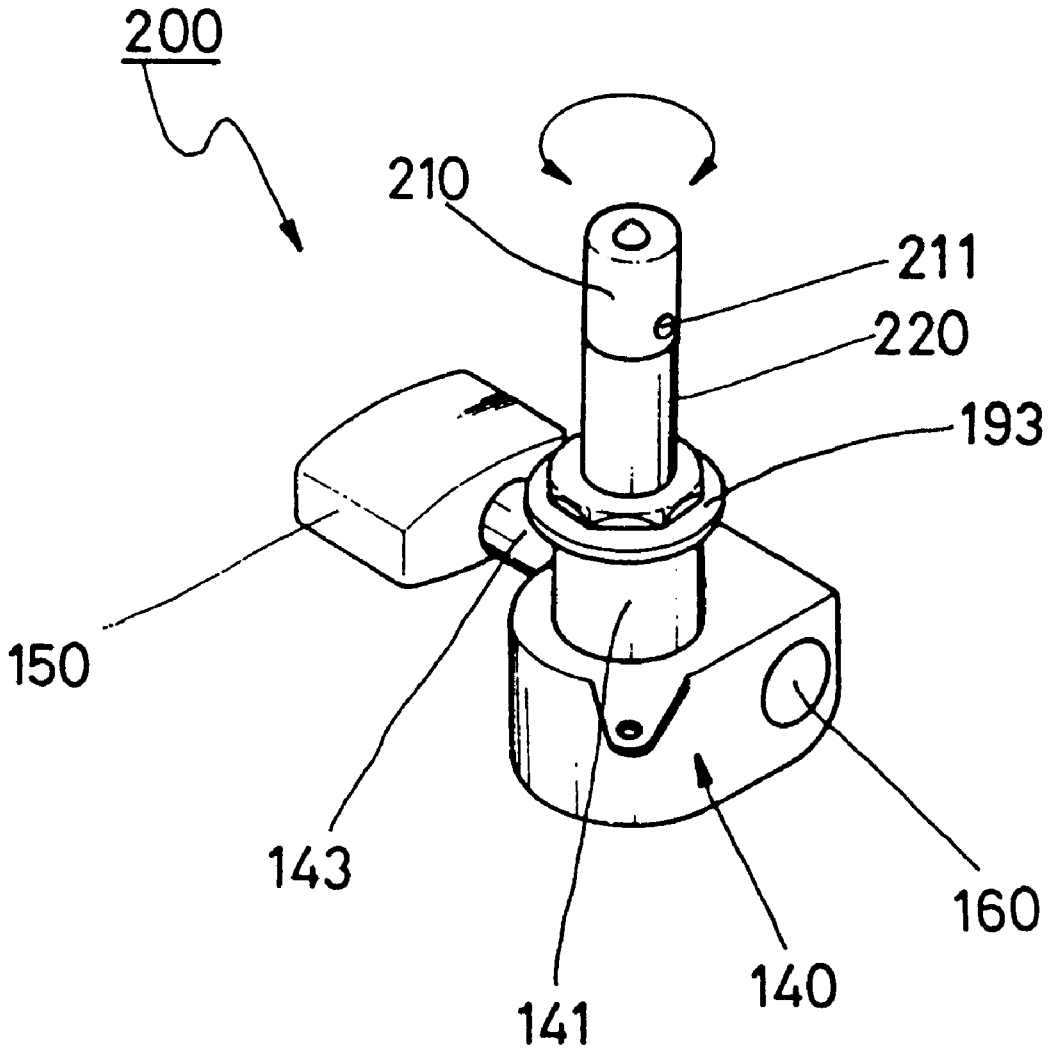
FIG. 4 is a perspective view of a machine head in accordance with the second embodiment of the present invention.
Figure 5:
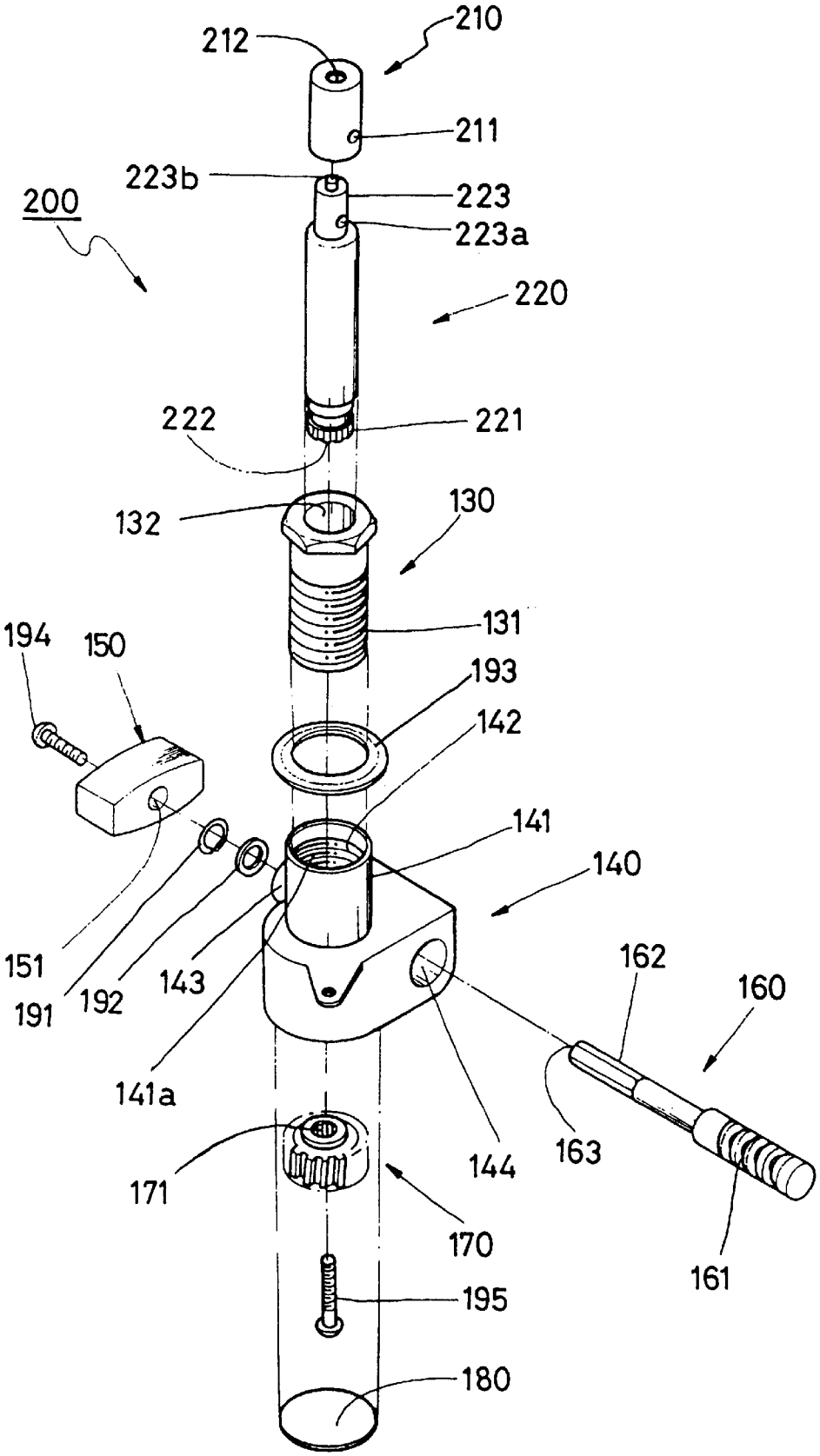
FIG. 5 is an exploded perspective view of the machine head in FIG. 4.

FIG. 4 is a perspective view of a machine head in accordance with the second embodiment of the present invention. FIG. 5 is an exploded perspective view of the machine head in FIG. 4. As shown in the drawings, the general shape of the second embodiment remains the same as that described for the primary embodiment, but both the string holding cap and the winding peg are altered as follows.

In the machine head 200 according to the second embodiment, a serrated portion 221 is formed at the stepped lower end of the winding peg 220 and engages with the serration 171 of the worm wheel 170. Of course, the winding peg 220 is used for winding or unwinding the string thereon or therefrom, thus adjusting the tension of the string. An internal thread 222 is formed on the lower end portion of the winding peg 220, thus allowing the second set screw 195 to be threaded into the winding peg 220 and to assemble the worm wheel 170 with the winding peg 220.

A cap guider 223 is formed at the top end of the winding peg 220 and is covered with a string holding cap 210. A first string insert hole 223*a* is radially formed on the guider 223 so as to be perpendicular to the axis of the winding peg 220. A bearing projection 223*b* is upwardly formed at the top end of the above guider 223 and rotatably holds the cap 210 around the cap guider 223.

On the other hand, the string holding cap 210 has a second string insert hole 211 on its sidewall in a way such that the second hole 211 is operated in conjunction with the first hole 223*a* of the guider 223. A bearing hole 212 is formed at the top wall of the cap 210 so as to rotatably receive the bearing projection 223*b* of the guider 223 therein. In order to rotatably assemble the cap 210 with the winding peg 220, the cap 210 is fitted over the guider 223 with the bearing projection 223*b* of the guider 223 received into the bearing hole 212 of the cap 210. The cap 210 is, thereafter, rotatably held on the guider 223 of the winding peg 220 by the bearing projection 223*b* through a riveting process.

In order to hold a string to the machine head 200, the second string insert hole 211 of the cap 210 is aligned with the first string insert hole 223*a* of the guider 223 before one end of the string passes through the two string holes 211 and 223*a*. Thereafter, the cap 210 is rotated in either direction as shown by the arrow of FIG. 4. That is, when the cap 210 is rotated in either direction with the end of the string passing through the two string holes 211 and 223*a*, the string is bent and firmly jammed at the junction between the guider 223 and the cap 210. The string is thus held on the winding peg 220.

After the string is jammed at the junction, the adjusting knob 150 is rotated. Due to the rotating action of the knob 150, the worm shaft 160 is also rotated along with both the worm wheel 170 and the winding peg 220. The string holding cap 210 is rotated in conjunction with the winding peg 220 while winding the string thereon. In such a case, the desired tension of the string is achieved by a precise rotating action of the adjusting knob 150 in either direction.

Figure 6:
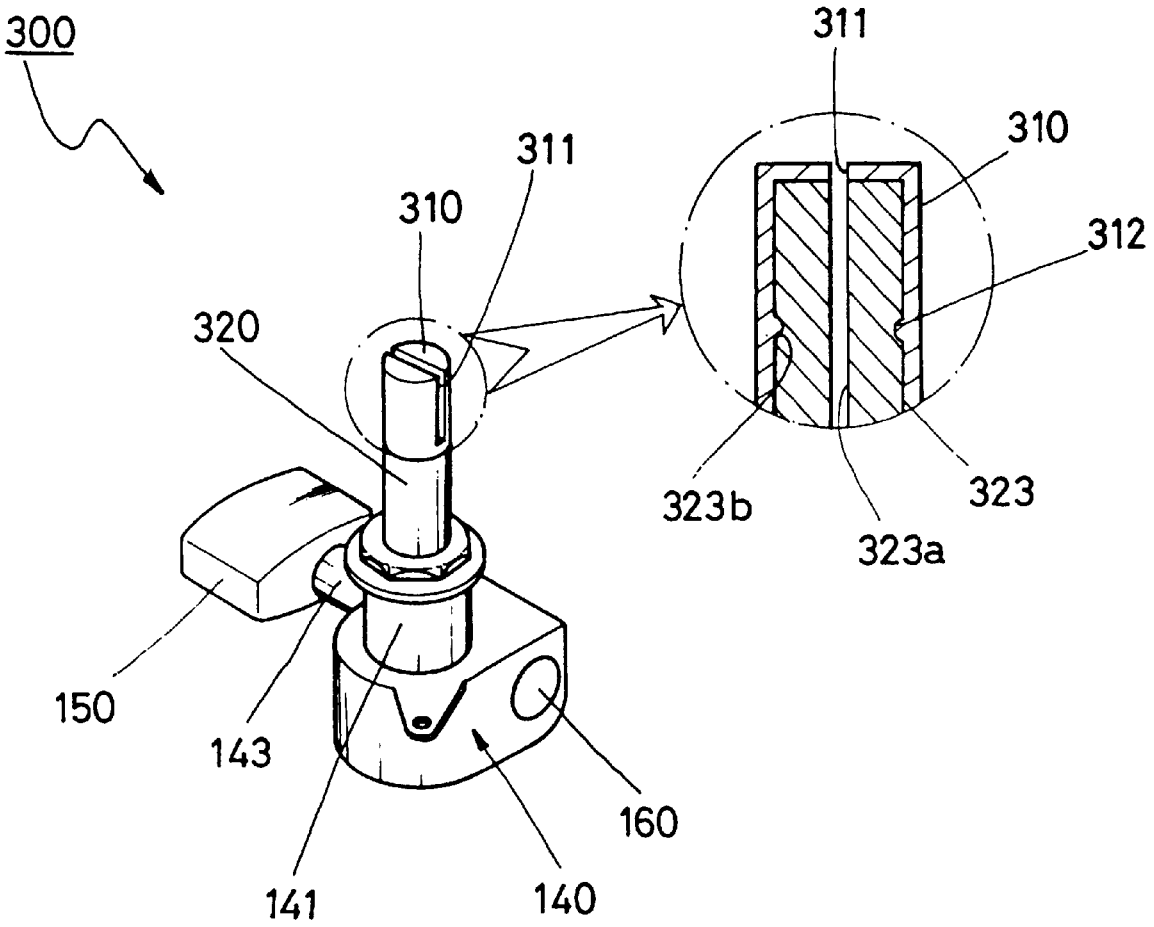
FIG. 6 is a perspective view of a machine head in accordance with the third embodiment of the present invention.
Figure 7:
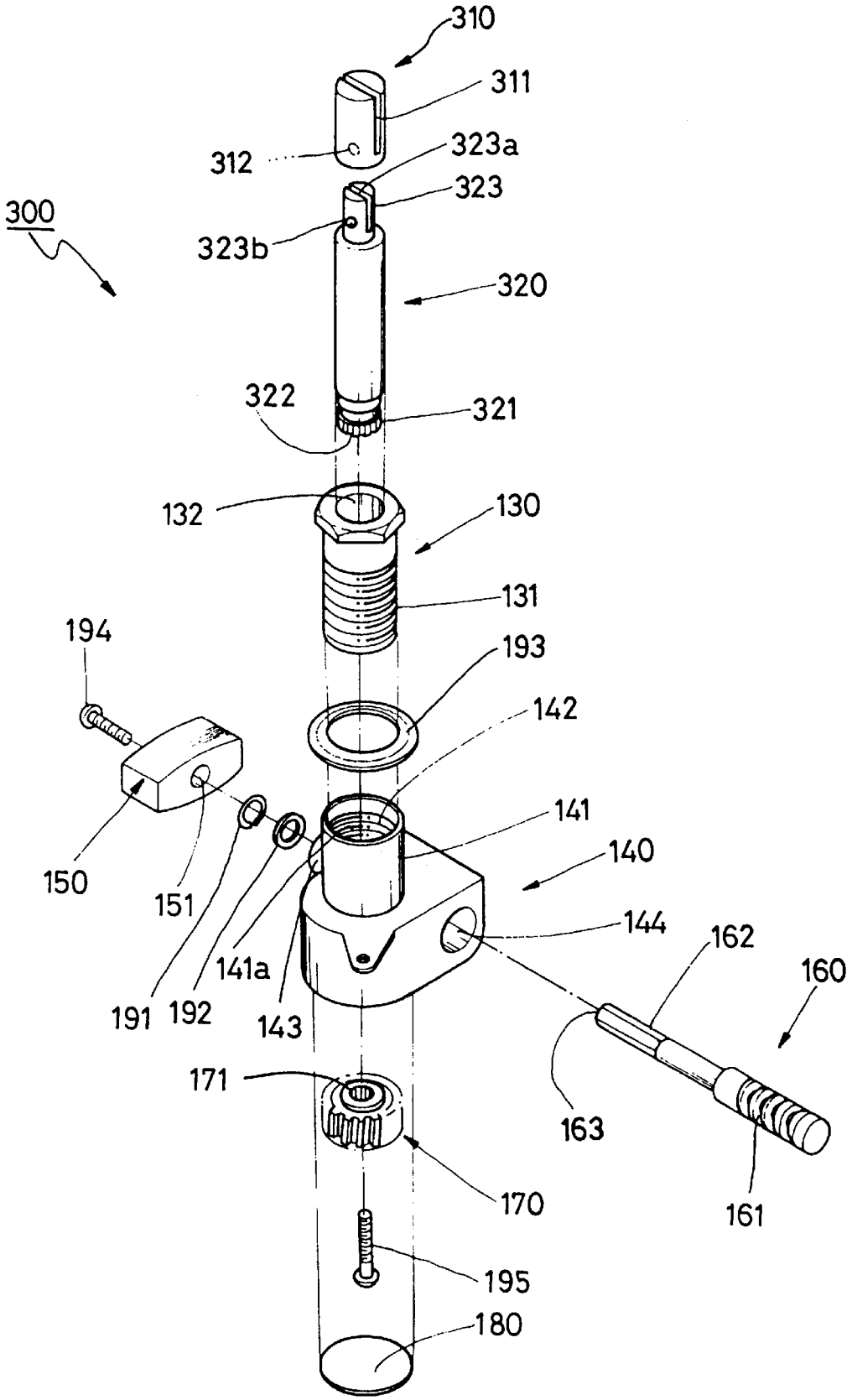
FIG. 7 is an exploded perspective view of the machine head in FIG. 6.
Figure 8:
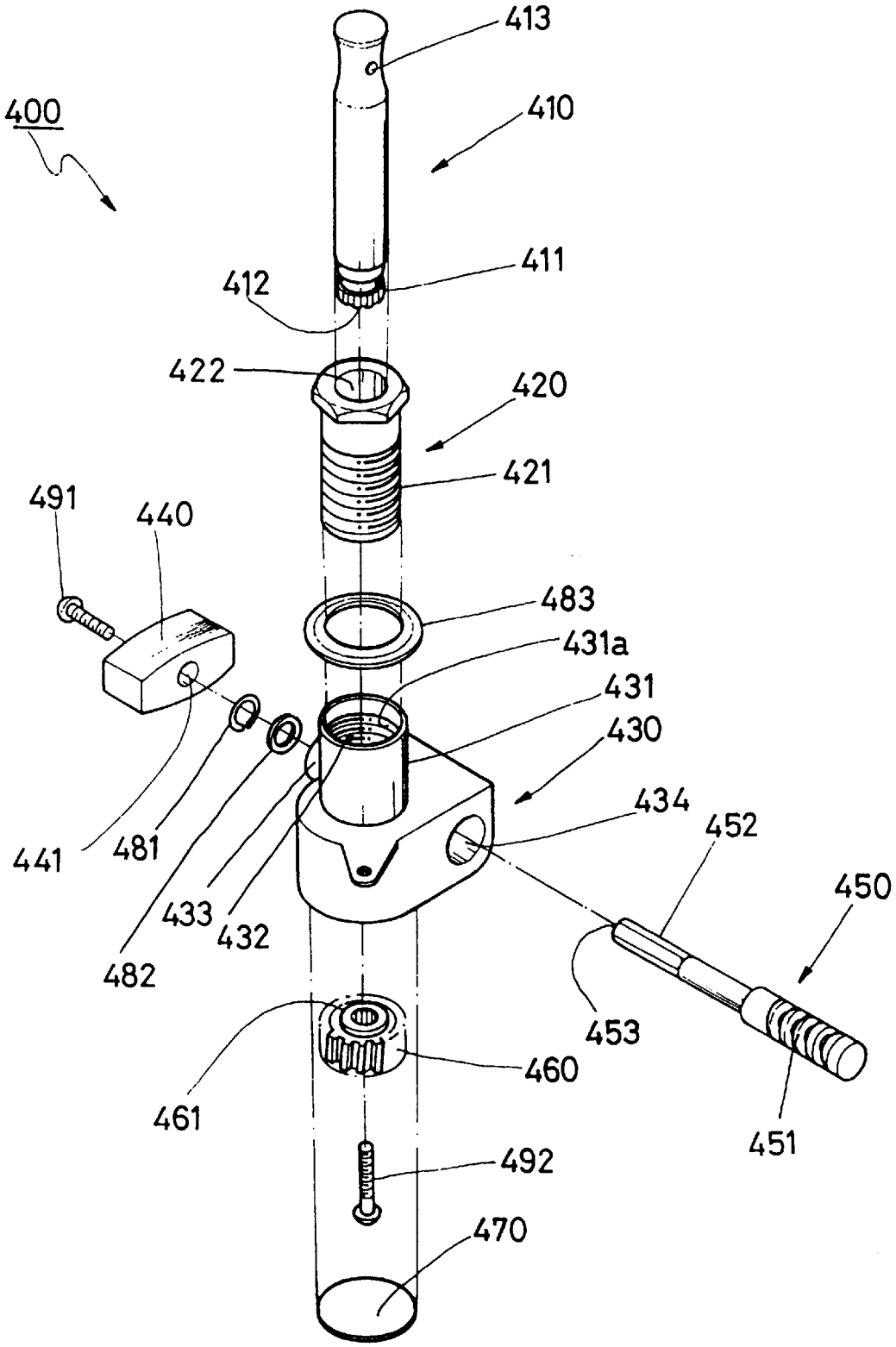
FIG. 8 (PRIOR ART)
FIG. 8 is an exploded perspective view of a conventional machine head for guitars.
Figure 9:
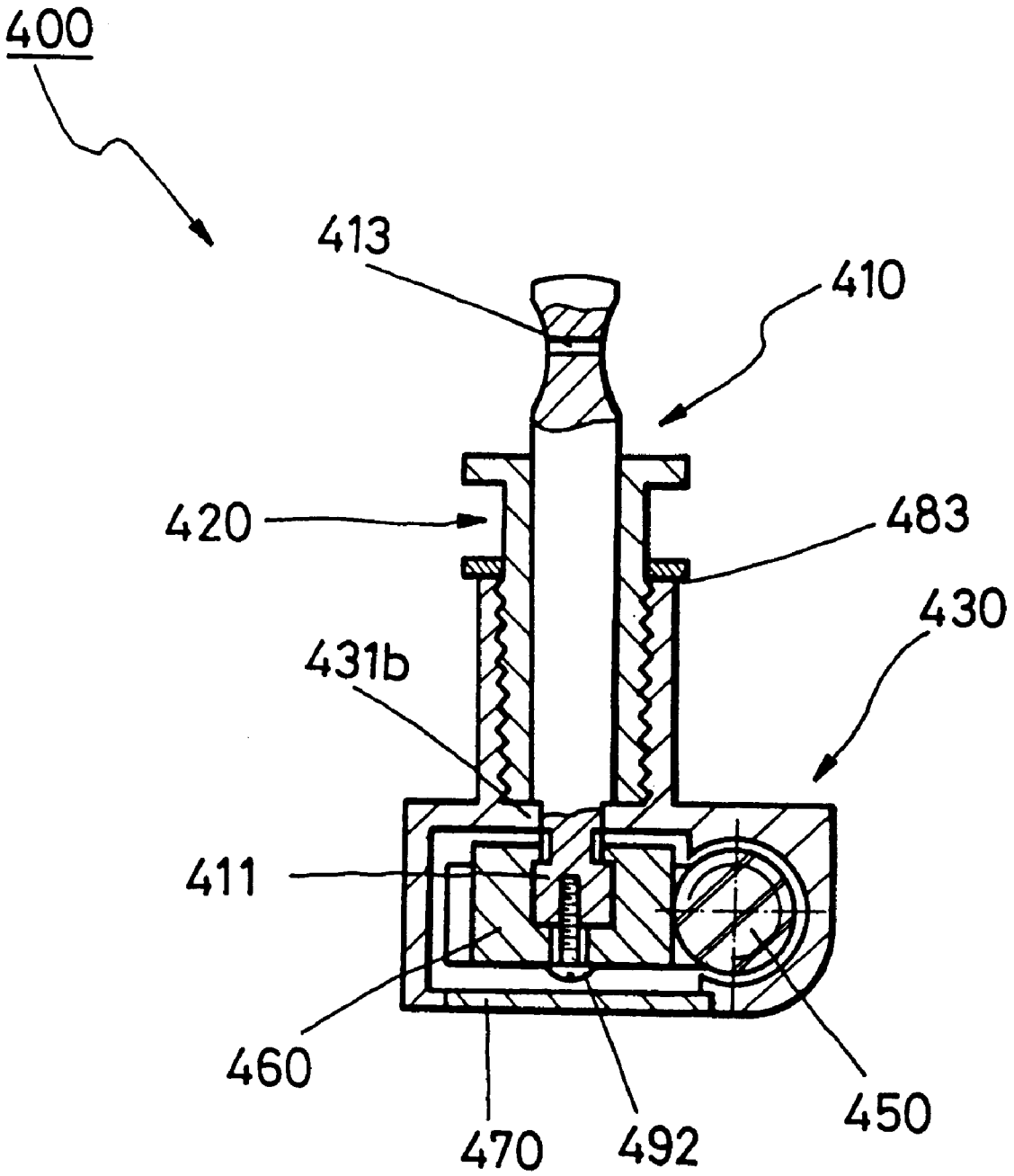
FIG. 9 (PRIOR ART)
FIG. 9 is a sectional view of the machine head of FIG. 8.

FIG. 6 is a perspective view of a machine head in accordance with the third embodiment of this invention. FIG. 7 is an exploded perspective view of the machine head in FIG. 6. As shown in the drawings, the general shape of the third embodiment remains the same as that described for the primary and second embodiments, but both the string holding cap and the winding peg are altered as follows.

In the machine head 300 according to the third embodiment, a serrated portion 321 is formed at the stepped lower end of the winding peg 320 and engages with the serration 171 of the worm wheel 170. Of course, the winding peg 320 is used for winding or unwinding the string thereon or therefrom, thus adjusting the tension of the string. An internal thread 322 is formed on the lower end portion of the winding peg 320, thus allowing the second set screw 195 to be threaded into the winding peg 320 and to assemble the worm wheel 170 with the winding peg 320.

A cap guider 323 is formed at the top end of the winding peg 320 and is covered with a string holding cap 310. A first string insert slit 323*a* is diametrically formed on the guider 323 along the axis of the winding peg 320. A locking projection 323*b* is outwardly formed on the external surface of the above guider 323 in a radial direction.

On the other hand, the string holding cap 310 has a locking slot 312 on the interior surface of its sidewall in a way such that the slot 312 is operated in conjunction with the projection 323*b* of the guider 323. A second string insert slit 311 is diametrically formed on the cap 310 so as to be operated in conjunction with the first slit 323*a* of the guider 323. After the cap 310 is fitted over the guider 323 of the winding peg 320, the cap 310 is rotated around the guider 323 until the projection 323*b* of the guider 323 is removably seated into the slot 312 of the cap 310. The cap 310 is thus temporarily locked to the guider 323.

When the cap 310 is temporarily locked to the guider 323 with the projection 323*b* seated in the slot 312, the second slit 311 of the cap 310 is aligned with the first slit 323*a* of the guider 323. A string is, thereafter, inserted into the aligned slits 311 and 323*a* prior to rotating the cap 310 around the guider 323 in either direction. The string is thus bent and firmly jammed at the junction between the guider 323 and the cap 310. The string is held on the winding peg 320.

After the string is jammed at the junction, the adjusting knob 150 is rotated. Due to the rotating action of the knob 150, the worm shaft 160 is also rotated along with both the worm wheel 170 and the winding peg 320. The string holding cap 310 is rotated in conjunction with the winding peg 320 while winding the string thereon. In such a case, the desired tension of the string is achieved by precisely rotating the adjusting knob 150 in either direction.

As described above, the present invention provides a machine head for guitars. In the machine head, a cap guider is formed at the top end of the winding peg and is rotatably covered with a string holding cap, with a string being jammed and firmly held at the junction between the cap and the guider. The string is thus prevented from being unexpectedly removed from the winding peg. It is possible for a user to easily hold a string to the winding peg of the machine head without catching the end of the string with the fingers.

Although an illustrative embodiment of the present invention has been described herein with reference to the accompanying drawings, it is to be understood that various changes and modification may be effected therein by those skilled in the art without departing from the scope or spirit of the invention.

What is claimed is:

1. A machine head for adjusting the tension of a string in guitars by sequentially rotating a manually operated adjusting knob, a worm engaging with said knob, a worm wheel engaging with said worm, and a winding peg integrated with the worm wheel with the string wound on or unwound from said winding peg, further comprising:

a cap guider formed on a top end of said winding peg and having upper and lower guide discs integrated with both ends of an eccentric shaft; and a string holding cap rotatably fitted over said cap guider, thus being brought into a rotatable engagement with the guider, said string holding cap having two string insert holes on its sidewall at eccentric positions.

2. A machine head for adjusting the tension of a string in guitars by sequentially rotating a manually operated adjusting knob, a worm engaging with said knob, a worm wheel engaging with said worm, and a winding peg integrated with the worm wheel with the string wound on or unwound from said winding peg, further comprising:

a cap guider formed on a top end of said winding peg, said guider having:

a first string insert hole radially formed on said guider while being perpendicular to an axis of said winding peg; and a bearing projection upwardly formed on a top end of said guider; and a string holding cap rotatably fitted over said cap guider of the winding peg, thus being brought into a rotatable engagement with the guider, said string holding cap having:

a second string insert hole formed on a sidewall of the cap and operated in conjunction with said first string insert hole; and a bearing hole formed on a top wall of said cap and rotatably receiving the bearing projection of the guider therein, with the cap rotatably held on the guider by the bearing projection through a riveting process.

3. A machine head for adjusting the tension of a string in guitars by sequentially rotating a manually operated adjusting knob, a worm engaging with said knob, a worm wheel engaging with said worm, and a winding peg integrated with the worm wheel with the string wound on or unwound from said winding peg, further comprising:

a cap guider formed on a top end of said winding peg, ith a first string insert slit diametrically formed on the guider along an axis of s aid winding peg; and a string holding cap rotatably fitted over said cap guider of the winding peg, thus being brought into a rotatable engagement with the guider, with a second string insert slit diametrically formed on said cap and operated in conjunction with the first string insert slit of the guider while holding the string on the winding peg.

4. The machine head as claimed in claim 3, wherein a locking projection is outwardly formed on an external surface of said guider in a radial direction, and a locking slot is formed on an interior surface of a sidewall of said string holding cap, said locking projection of the guider being removably seated into said locking slot of the cap with the first and second string insert slits being aligned with each other.

* * * * *